United States Patent [19]

Head et al.

[11] Patent Number: 4,730,428

[45] Date of Patent: Mar. 15, 1988

[54] LOAD BEARING FLOOR OR ROOF MEMBERS

[75] Inventors: Peter R. Head, Beckenham; Roy B. Templeman, Bromley, both of England

[73] Assignee: G. Maunsell & Partners, London, England

[21] Appl. No.: 904,831

[22] Filed: Sep. 8, 1986

Related U.S. Application Data

[63] Continuation of Ser. No. 547,924, Nov. 2, 1983, abandoned.

[30] Foreign Application Priority Data

Nov. 5, 1982 [GB] United Kingdom ..... 8231688

[51] Int. Cl.[4] ..... E04B 5/00

[52] U.S. Cl. ..... 52/309.11; 52/586; 52/484

[58] Field of Search ..... 52/586, 484, 779, 309.7, 52/309.11, DIG. 7, 309.1

[56] References Cited

U.S. PATENT DOCUMENTS

| | | | |
|---|---|---|---|
| 2,585,051 | 2/1952 | Simon | 52/241 |
| 3,803,789 | 4/1974 | Gibson . | |
| 3,828,496 | 8/1974 | Testaguzza et al. | 52/309.11 |
| 3,940,893 | 3/1976 | Rausch et al. | 52/586 |
| 4,026,081 | 5/1977 | Delaney et al. | 52/779 |
| 4,078,348 | 3/1978 | Rothman | 52/309.11 |

FOREIGN PATENT DOCUMENTS

| | | | |
|---|---|---|---|
| 661203 | 4/1962 | Canada | 52/309.1 |
| 1258454 | 3/1961 | France | 52/586 |
| 1357476 | 2/1964 | France | 52/309.1 |
| 2485591 | 12/1981 | France | 52/484 |
| 936553 | 9/1963 | United Kingdom . | |
| 1133501 | 11/1968 | United Kingdom . | |
| 1228684 | 4/1971 | United Kingdom . | |
| 1286074 | 8/1972 | United Kingdom . | |
| 1338536 | 11/1973 | United Kingdom . | |
| 1350298 | 4/1974 | United Kingdom . | |
| 1534501 | 12/1978 | United Kingdom . | |
| 2041489 | 9/1980 | United Kingdom . | |

OTHER PUBLICATIONS

House & Home, vol. 15, Issue 2, p. 142c, Feb. 1959.

*Primary Examiner*—Carl D. Friedman
*Assistant Examiner*—Caroline D. Dennison
*Attorney, Agent, or Firm*—Cushman, Darby & Cushman

[57] ABSTRACT

A load bearing floor or roof member is in the form of a flat plank member. It has flat major upper and lower walls and flat minor side walls. It is a rigid, hollow, integral structure of fibre reinforced plastics material, with a rigid plastics foam filling. In each minor side wall is an integral undercut channel which is shaped to receive slidably a connector portion of a connector member, which connector portion is of head and neck shaped cross section.

5 Claims, 9 Drawing Figures

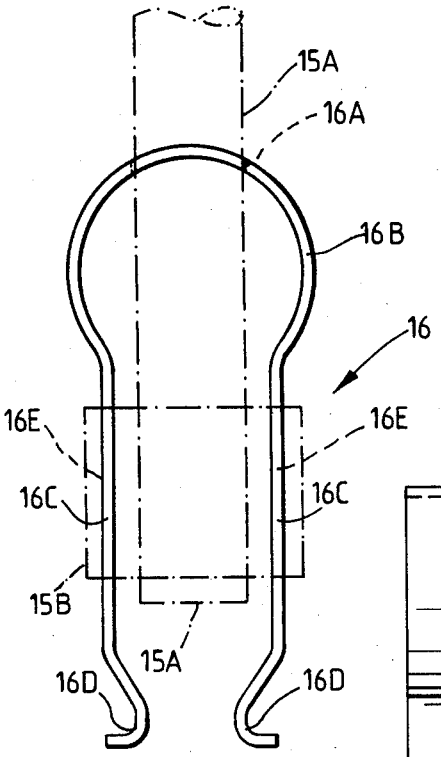
Fig.7.
Fig.8.
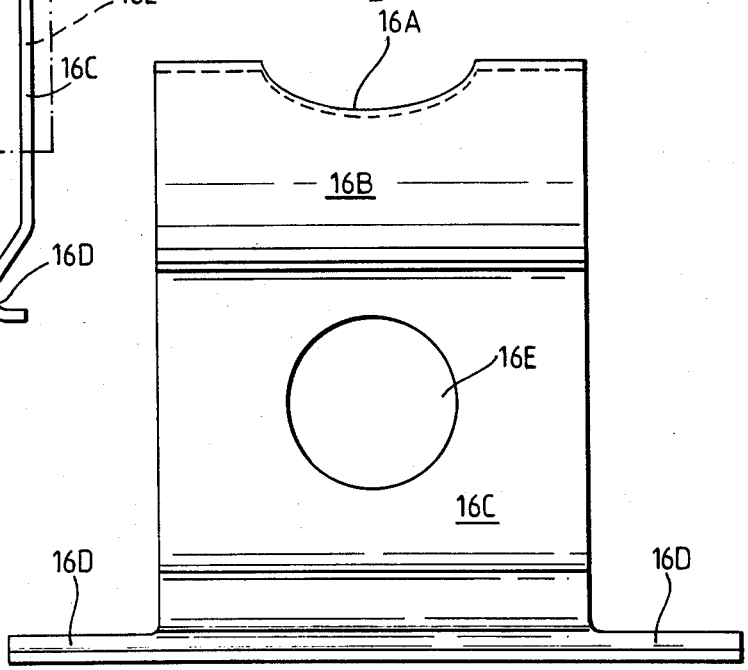
Fig.9
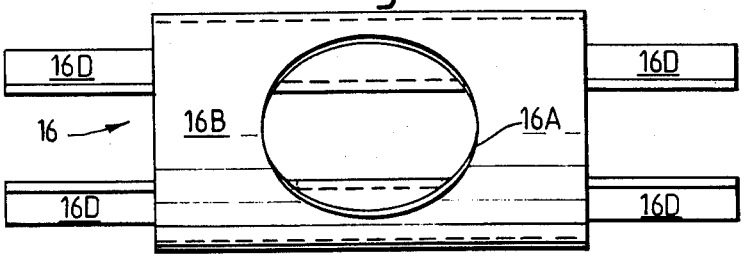

LOAD BEARING FLOOR OR ROOF MEMBERS

This is a continuation of application Ser. No. 547,924, filed Nov. 2, 1983, which was abandoned upon the filing hereof.

BACKGROUND OF THE INVENTION

1. Field of the Invention

This invention relates to the field of structural materials and more particularly to load bearing floor or roof members, to systems made of such members and using connecting members for connecting the floor or roof members into a floor or roof system, and to means for supporting such a system.

2. Description of the Prior Art

U.S. Pat. No. 4,078,348 (Rothman) discloses a construction panel comprising a core of expanded or foamed polymeric material embodied between two major face members of resin reinforced with glass fibres. The side walls of the panel comprise pultrusion angle members which are encapsulated in the panel within the major face members. Elongated U-shaped pultrusion reinforcing members may be disposed within the panel to provide reinforcement and a channel for the receipt of wires, pipes, or to act as heating, air conditioning or vacuum cleaning ducts. The glass fibres used to reinforce the major face members are in multidirectional orientation and have portions extending into the interior of the panel to provide a mechanical and chemical bond between the core and the major face members. The pultrusion members may be made from resin reinforced with continuous strands of glass fibres in unidirectional orientation, and are preferably prestressed. This known panel is composed of several separate members, i.e. an upper major face member, a lower major face member, pultruded end face members or side walls, and, if required, pultruded reinforcing members within the panel. Panels are connected together by bolts passing through the pultruded end face members or side walls of adjacent panels. This known panel thus requires separate manufacture of a number of seperate members, which members must then be assembled together to form the panel.

SUMMARY OF THE INVENTION

It is desirable to provide a load bearing floor or roof member in the form of a flat plank member which can be manufactured in a single operation and which can be so formed as to provide for simple connection to an adjacent floor or roof member or members. It is also desirable to provide such a flat plank member, or a connector member between adjacent plank members, with a simple means of support, for example by a suspension type of support or a pedestal type of support.

The expression "load bearing" is used herein to refer primarily to a load which acts generally transversely to the major plane of the flat plank member or of a floor or roof system made up of such members.

According to one aspect of this invention a load bearing floor or roof member in the form of a flat plank member comprises:

an upper major face wall; a lower major face wall spaced from the upper major face wall; opposed side walls; and a rigid foam filling in the hollow space defined by the upper, lower and side walls, the flat plank member being characterized in that:

(i) the flat plank member is a rigid, hollow, integral, pultruded structure of fibre reinforced plastics material, with the major face walls and the opposed side walls being formed in a single pultrusion operation;

(ii) each integral opposed side wall has a flat outer surface disposed substantially at right angles to the plane in which at least one of the major face walls lies; and (iii) at least one of the integral opposed side walls has formed therein an integral undercut channel which is shaped to receive slidably a connector portion of at least one connector member which connector portion is of head and neck shaped cross section.

The integral flat plank member may have one or more than one internal stiffening web joined at its upper and lower ends respectively to the said upper and lower major face walls. The or each web is preferably formed together with the walls in the pultrusion operation. Similarly the rigid plastics foam filling may also be provided in the pultrusion operation.

According to another aspect of the invention a load bearing floor or roof system comprises (a) means for supporting the system, and (b) two or more flat plank members, each flat plank member comprising: an upper major face wall; a lower major face wall spaced from the upper major face wall; and opposed side walls, characterised in that:

(i) each flat plank member is a rigid, hollow, integral, pultruded structure of fibre reinforced plastics material, with the major face walls and the opposed side walls being formed in a single pultrusion operation; and (ii) connector means are provided for connecting the supporting means to the plank members.

According to another aspect of the invention there is provided an elongate structural connector member for joining adjacent flat plank members to form a floor or roof system, the connector member comprising:

a flat upper wall; a flat lower wall spaced from and parallel to the upper wall; a first flat side wall joining the upper and lower walls; and a second flat side wall joining the upper and lower walls and spaced from and parallel to the first flat side wall; characterised in that:

(i) the upper wall is slotted to provide an undercut channel to receive supporting or mounting means;

(ii) a connector portion projects laterally from each side wall, the two connector portions projecting in opposite directions and each connector portion being head and neck shaped in cross section; and (iii) the elongate structural connecting member is a rigid, hollow, integral, pultruded structure of fibre reinforced plastics material, with the walls and connector portions all being formed in a single pultrusion operation.

Preferably each connector portion is solid. Preferably also a transverse web extends across the interior of the member from the first side wall to the second side wall, generally at the level of the two oppositely projecting connector portions.

In the flat plank member described above, the use of an integral side wall with a flat outer surface in which is formed an undercut channel to receive slidably a connector portion of a connector member, can provide for simpler and more effective manufacture by pultrusion. It can also provide the finished flat plank member with better strength properties. The relatively simple cross sectional shapes employed assist in avoiding the formation of wall thickness variations with attendant weakness at thinner locations. Further, the cross sectional shapes employed assist in correct location of the reinforcement material, particularly for example glass fibre reinforcing mat, within the body of the plastics material as it, and the reinforcement, are being pultruded. It is thus important to reduce as far as possible wall thickness irregularities and also to maintain the reinforcing fibres and fibrous mat in correct locations in the finished wall sections. If a rigid foam filling is used, particularly if it is incorporated in the flat plank member during the pultrusion operation, it can impart structural strength to the member and in fact when the width of the plank member is not great in relation to its height or thickness, reinforcing webs can be omitted.

BRIEF DESCRIPTION OF THE DRAWINGS

Embodiments of the invention will now be described by way of example, with reference to the drawings in which:

FIGS. 7, 8 and 9 are respectively end, side and top views of a supporting hanger clip.

DETAILED DESCRIPTION OF THE PREFERRED EMBODIMENTS

Figure 1:
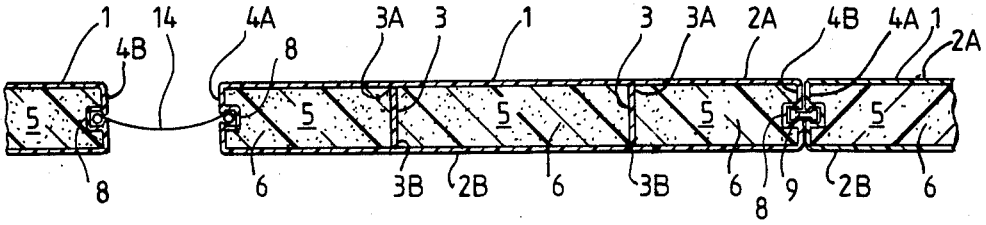
FIG. 1 is a diagrammatic section of one flat plank member, showing parts of adjacent plank members.
Figure 2:
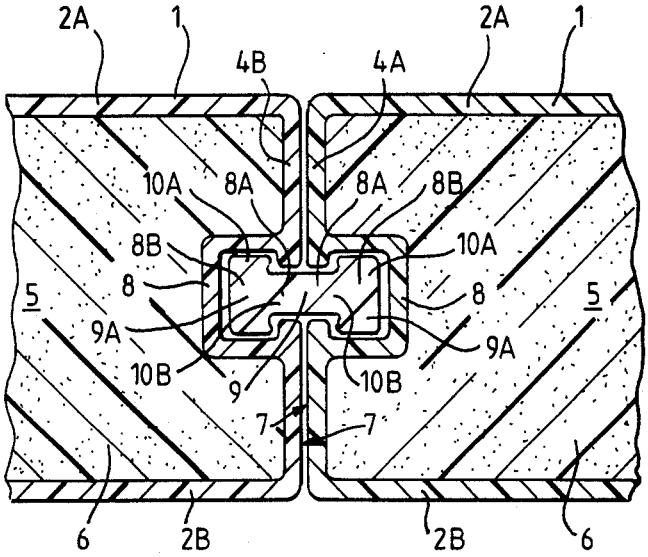
FIG. 2 is an enlarged section of the side parts of two adjacent plank members, with a connector member joining the two plank members together with their adjacent side walls having their flat surfaces in contact.

Referring to FIGS. 1 and 2 there is shown one embodiment of flat plank member 1 in accordance with the invention. A floor made up of such plank members is intended for use for example in a protective and access system for a bridge, and depending from the bridge. Such a floor can also form part of a protective membrane depending from a bridge having steel girders.

The flat plank member 1 comprises a flat upper major face wall 2A; a flat lower major face wall 2B spaced from and parallel to the wall 2A; and two internal shear stiffening webs 3, each joined at its upper end 3A to the wall 2A and at its lower end 3B to the wall 2B. The flat plank member 1 also comprises opposed, flat, parallel side walls 4A, 4B. As will be seen the walls 2A, 2B, 4A and 4B define a hollow space, which in this embodiment is divided up by the webs 3 into three hollow chambers 5. This hollow space is filled with rigid closed cell polyurethane foam 6. This rigid foam filling 6 confers increased structural stiffness, durability and thermal insulation properties on the plank member 1. It would be possible to omit the webs 3 in a plank member not so wide as the plank member 1 shown in FIG. 1, and rely for internal stiffening on the rigid foam filling.

The flat plank member 1 is a rigid, hollow, integral, pultruded structure of glass fibre reinforced plastics material. It is formed in a single pultrusion operation. In the technique known as "pultrusion" a complete member can be pulled from an aperture of appropriate shape. By this technique, continuous glass reinforcing rovings and mat impregnated with plastics material can be pulled through a heated die system. The complete member is heated and cured as it is pulled from the die system. The rigid closed cell foam filling is preferably foamed into the member as part of the continuous process of manufacture, although it may alternatively be placed in the member at a later stage.

Thus the walls 2A, 2B, and 4A, 4B, the webs 3, and preferably also the filling 6, are all formed in a single pultrusion operation.

Referring particularly to FIG. 2, it will be seen that each integral opposed side wall 4A, 4B has a flat surface 7 disposed at right angles to the plane in which the upper major face wall 2A lies. In this embodiment each side wall 4A, 4B has formed therein an integral undercut channel 8. Each undercut channel 8 is shaped as shown, with a slot 8A (see also FIG. 6) in the wall 4A or 4B, leading to an enlarged cavity 8B. The shape of each undercut channel 8 is thus such as to receive slidably one of two oppositely projecting connector portions 9A of a solid pultruded connector member 9. Each connector portion 9A is of head and neck shaped cross section as shown, with a head 10A and a neck 10B.

It will be understood from FIG. 2 that the side walls 4A, 4B lie close together, virtually without a gap, and that the solid connector member 9 is virtually surrounded by the two adjacent flat plank members 1. The solid connector member 9 not only connects the members 1 together, but provides shear continuity in a floor or roof made up of the members 1.

Figure 3:
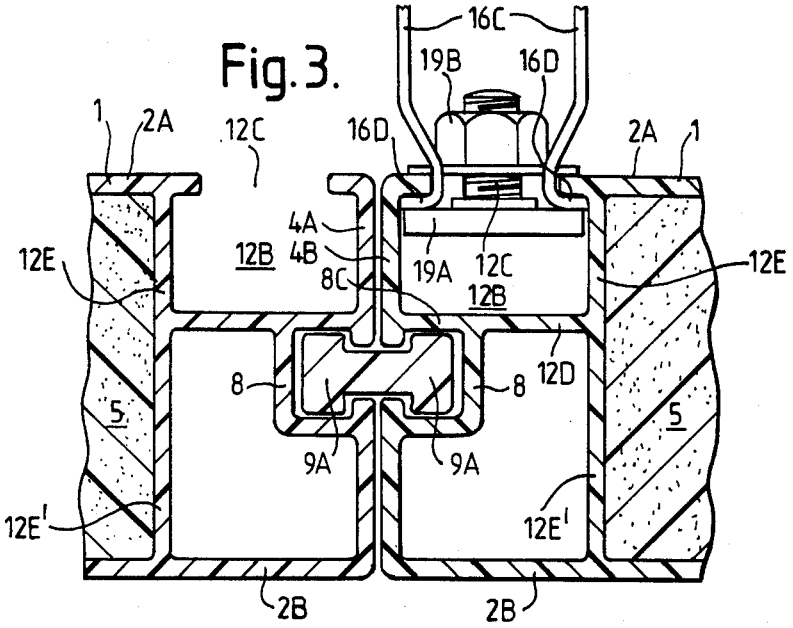
FIG. 3 is a view similar to FIG. 2, but showing another embodiment, with part of a supporting member clamped into the top of one plank member.

FIG. 3 shows side parts of two adjacent plank members 1 of another embodiment of the invention. Each plank member 1 of this embodiment is generally similar to the first embodiment, except that at each side the plank member has an upwardly facing undercut channel 12B with a slot 12C in the upper wall 2A. The lower wall 12D of this channel is an inward extension of the upper wall 8C of the undercut channel 8 in the side wall 4B of the plank member. The inner side wall 12E of the undercut channel 12B is continued downwardly as a web 12E' to connect with the lower wall 2B, as shown. The connection between the two plank members 1 of this embodiment is the same as described above with reference to FIG. 2. Also as shown, one of the undercut channels 12B receives a supporting member in the form of a hanger assembly which will be described below. (Alternatively a pedestal-like mounting member could be connected to the plank member 1 with the latter inverted, for example when a roof or floor is to be supported from below). The upwardly facing undercut channel 12B at the left-hand side of the left-hand plank member could also receive another hanger assembly.

Figure 4:
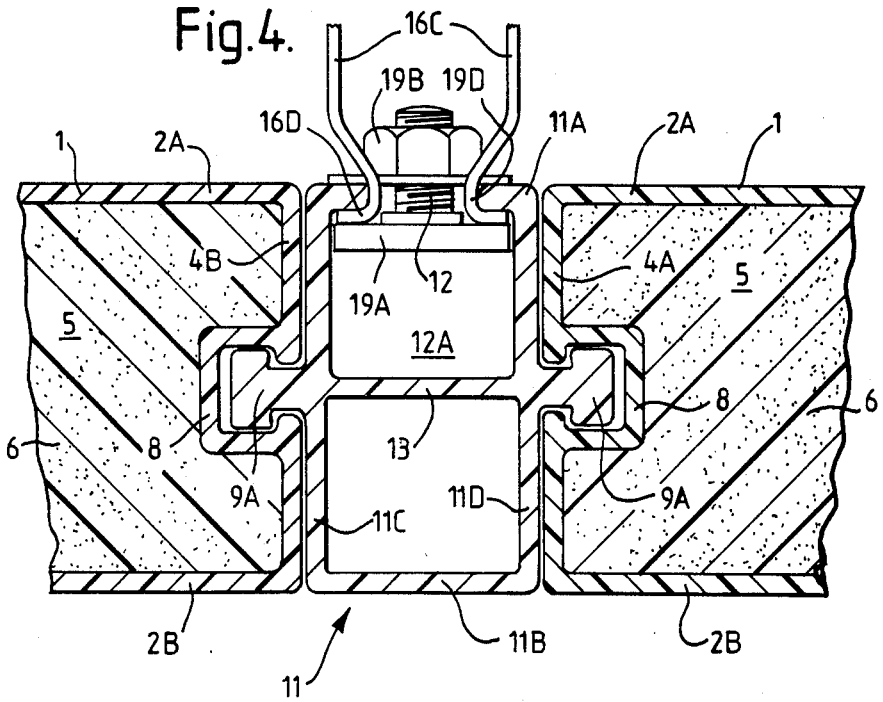
FIG. 4 is also a view similar to FIG. 2, but showing another form of connector member, with part of a supporting member clamped into the top of the connector member.

FIG. 4 shows another embodiment of connector member 11 which also provides shear continuity and in addition provides for supporting the flat plank members from above. In FIG. 4 the flat plank members 1 are identical with those seen in FIGS. 1 and 2. Also the connector member 11 has two oppositely projecting connector portions 9A which are slidably received in the undercut channels 8, just as is shown in FIG. 2.

Figure 6:
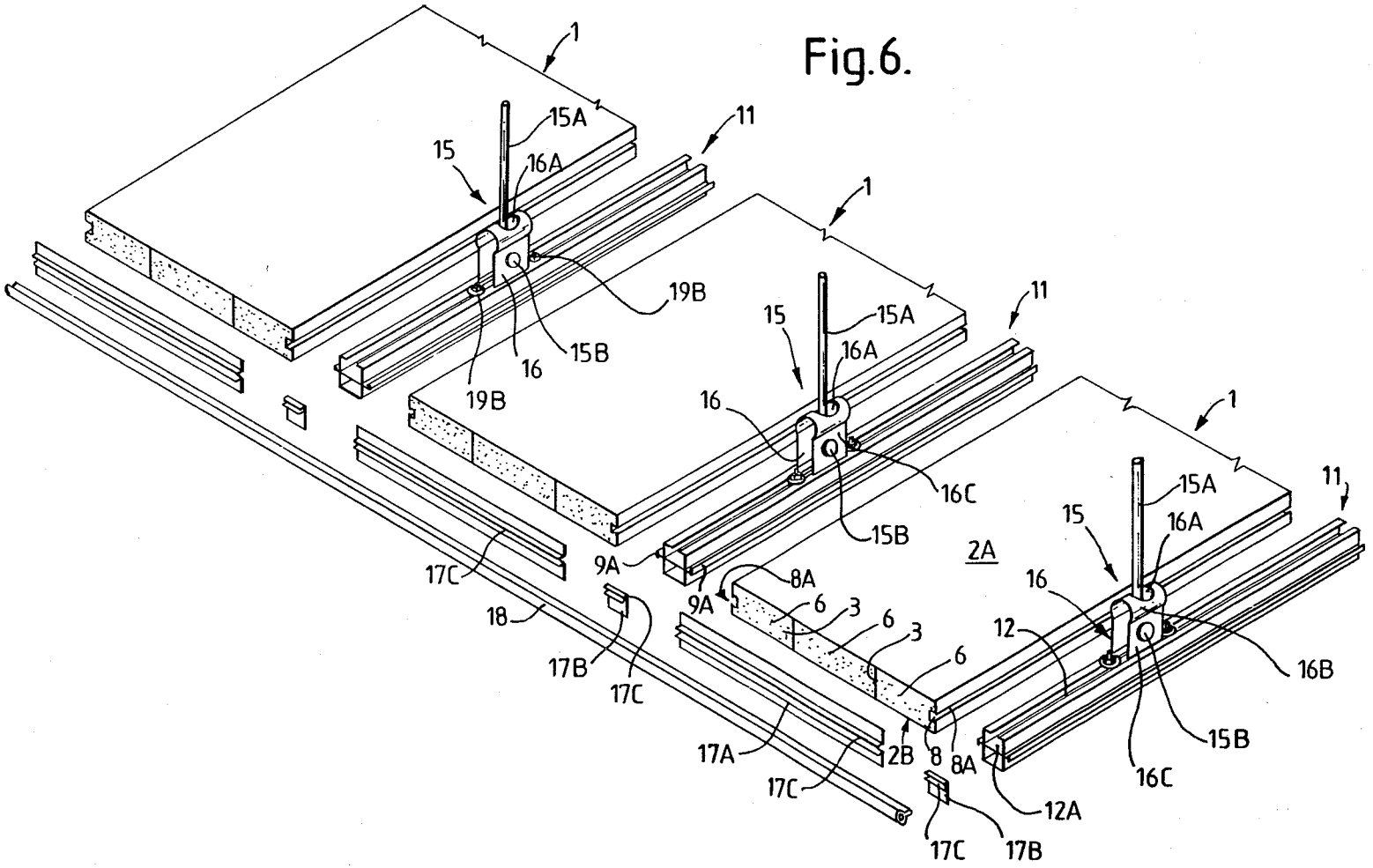
FIG. 6 is an isometric exploded view showing three flat plank members, with connector members, supporting hanger assemblies, and end caps.

The connector member 11 is an elongate structural connector member, as seen in FIG. 6. It has a flat upper wall 11A, a flat lower wall 11B spaced from an parallel to the upper wall 11A. Also it has a first flat side wall 11C joining the upper and lower walls 11A, 11B and a second flat side wall 11D also joining the upper and lower walls 11A, 11B, and spaced from and parallel to the first side wall 11C. The upper wall 11A has a slot 12 (see also FIG. 6) to provide an undercut channel 12A which receives a supporting member in the form of a hanger assembly which will be described below. (Alternatively a pedestal-like mounting member could be connected to the connector member 11 with the latter inverted, for example when a roof or floor is to be supported from below).

Each connector portion 9A projects laterally as shown in FIG. 4 from a respective side wall 11C, 11D, the portions 9A projecting in opposite directions. The connector portions 9A are otherwise the same as those described above with reference to FIG. 2.

The elongate structural connector member 11 is a rigid, hollow, integral, pultruded structure of glass fibre reinforced plastics material, with the walls 11A, 11B, 11C, 11D, the connector portions 9A, and an internal connector web 13 (which extends from the side wall 11C to the side wall 11D between the oppositely projecting connector portions 9A and which lies in the same plane as the connector portions 9A) all being formed in a single pultrusion operation. The web 13 stiffens the connector member 11 and assists in giving good shear continuity.

Figure 5:
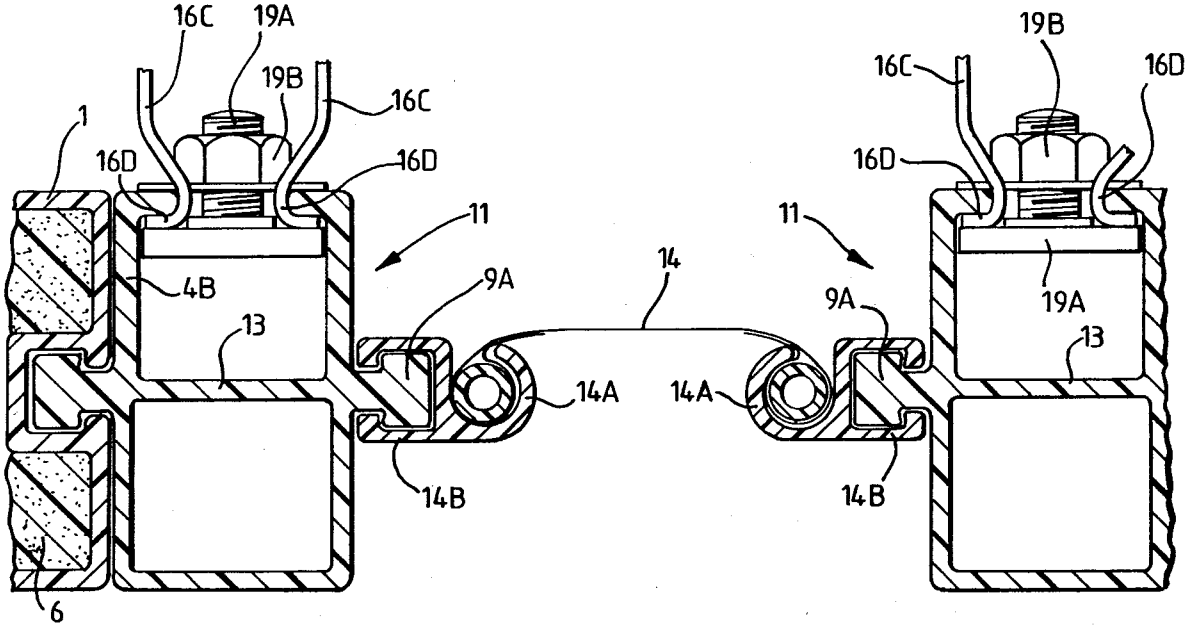
FIG. 5 is a view similar to FIG. 4, but showing two connector members (the right hand one being partly broken away) with a flexible membrane for covering a gap between adjacent flat plank members.

FIG. 5 shows a flexible member 14 for covering a gap between two flat plank members 1 (of which only the left hand one is seen in FIG. 5), using two connector members 11 each of which is supported by a hanger assembly, as will be described below. The flexible membrane 14 is of the kind known under the Trade Mark "Hypalon" and is clamped at each end by hook-section projections 14A of clips 14B which fit as shown over the heads of the portions 9A. The membrane 14, projections 14A and clips 14B extend throughout the length of the gap between the side walls of adjacent plank members 1. A membrane 14 is also shown diagrammatically in FIG. 1, but in that case the ends of the membrane are held in the respective undercut channels 8 in the adjacent side walls 4A, 4B of the plank members 1.

FIG. 6 shows three flat plank members 1 and three connector members 11 and it will be understood that the connector portions 9A can be slide endwise into the respective undercut channels 8, to join the plank members 1 together and to provide good shear continuity.

Also seen in FIG. 6 are three hanger assemblies 15 for suspending the floor, made up of the plank members 5 and connector members 11, from for example a bridge, to provide a walkway for access to the bridge girders. Each hanger assembly 15 has a suspension rod 15A passing down through a hole 16A of a clamping clip 16, seen in more detail in FIGS. 7 to 9.

FIG. 6 also shows end caps 17A and 17B for the plank members 1 and connector members 11. These caps are of moulded glass reinforced plastics material: they are fastened on to the ends of the several members 1 and 11. Each cap has a groove 17C to receive a sealing strip 18, preferably of for example synthetic rubber.

Referring to FIGS. 7 to 9 the clamping clip 16 is preferably of steel, with an upper bowed springy portion 16B and side arms 16C which terminate in clamping, hook-like ends 16D, seen also in FIGS. 4 and 5. These hook-like ends 16D extend outwardly and are urged outwardly by the action of the bowed portion 16B, as seen in FIG. 9, and fit into the slot 12C and undercut groove 12B (FIG. 3) or in the slot 12C and undercut groove 12A (FIGS. 4 and 5), being held in place by a turnable bolt head 19A and nut 19B, as shown. Each side arm 16C has a hole 16E to receive a cross-member 15B at the lower end of the suspension rod 15A of the hanger assembly.

The arrangement of a flat side wall with an undercut channel therein, as described above, permits a plank member to be used with a relatively high loading, because manufacture of the wall and channel parts of the plank member in a pultrusion operation can be kept to relatively close tolerances. The reason for this is that the pultrusion apparatus requires only a quite simple die shape to produce an undercut channel. The relatively close tolerances in turn permit the fibre reinforced plastics material to be formed with uniform wall thickness. This assists in proper placement of reinforcing fibre mat within the body of plastics material which forms the walls of the flat plank member, particularly the walls of the undercut channel and the side wall. If the die shape were required to be more complex, then difficulties could arise in the proper placement of the reinforcing fibre mat within the walls of plastics material being pultruded.

Another advantage of the construction described above is that the head and neck section connector portions 9A are protected within the undercut channels of the side walls, and are thus less vulnerable to damage by external agency, such as by being accidentally struck, In particular the embodiment of flat plank member system described with reference to FIGS. 1 and 2 provides a strong concealed connection and permits the adjacent sides of flat plank members to be located close together, providing a neat surface to a floor or roof embodying such system.

Another advantage is that the use of undercut channels in the respective side walls of a flat plank member permits the latter to be made, if required, with a relatively high ratio of height to width, "height" being the dimension between the upper and lower walls and "width" being the dimension between the two side walls.

The use of a supporting means such as the hanger assembly seen in FIGS. 3 to 6 and described with reference to FIGS. 7 to 9, provides a simple, quick and effective arrangement for the suspension of a floor or roof system, since the clamping clips 16 can readily be connected into the upwardly facing undercut channels. It will be understood that a pedestal type of mounting could alternatively be used if required, for example by inverting the flat plank member of FIG. 3, or the connector member of FIG. 4.

We claim:

1. A load bearing floor or roof system comprising (a) two or more plank members each plank member including a first major face wall, and a second major face wall spaced from the first major face wall, and opposed side walls, the plank member being a rigid, hollow, unitary pultruded structure of fibre reinforced plastics material, with the major face walls and the opposed side walls being formed in a single pultrusion operation, each opposed side wall having a flat outer surface disposed substantially at right angles to the plane in which at least one of the major face walls lies, and each of the opposed side walls having formed therein an integral undercut channel defined by a slot in the respective outer surface of the side wall and an enlarged inner cavity, and (b) one or more connector members for connecting together adjacent planks by interengagement with the opposed undercut channels of the respective planks, the or each connector member including first transverse wall, a second transverse wall spaced from and parallel to the first transverse wall, a first side wall joining the first and second transverse walls, and a second side wall joining the first and second transverse walls and spaced from and parallel to the first side wall, the first transverse wall including an opening to provide an undercut channel to receive supporting or mounting means, a connector portion projecting laterally from each side wall, the two connector portions projecting in opposite directions and each connector portion being head and neck shaped in cross-section, the undercut channels of the adjacent planks slidably receiving the opposed connector portions of a connector whereby the planks are restrained against lateral separation in the plane of the planks and transverse thereto and may be supported by supporting or mounting means being received in the channel in the first transverse wall of the connector.

2. A load bearing floor or roof system according to claim 1 wherein each plank member includes at least one internal stiffening web to form a unitary structure.

3. A load bearing floor or roof system according to claim 2 including a rigid plastics foam filling in the hollow space defined by the plank structure.

4. A load bearing floor or roof system according to claim 1 wherein the connector member includes an internal connector web extending between the first and second side walls of the connector member; and the, or each, supporting or mounting means comprises a hanger rod from which depends a clip which passes through the first transverse wall of the connector member to be received in, and held in, contact with the undercut channel.

5. A load bearing floor or roof system comprising (a) two or more plank members each plank member including a first major face wall, and a second major face wall spaced from the first major face wall, and opposed side walls, said walls forming a closed box structure the plank member being a rigid, hollow, unitary pultruded structure of fibre reinforced plastics material, with the major face walls and the opposed side wall having a flat outer surface disposed substantially at right angles to the plane in which at least one of the major face walls lies, and each of the opposed side walls having formed therein an integral undercut channel defined by a slot in the respective outer surface of the side wall and an enlarged inner cavity, and (b) one or more unitary connector members for connecting together adjacent planks by interengagement with the opposed undercut channels of the respective planks, the or each connector member including a first transverse wall, a second transverse wall spaced from and parallel to the first transverse wall, a first side wall joining the first and second transverse walls, and a second side wall joining the first and second transverse walls and spaced from and parallel to the first side wall, the width of said first and second transverse walls being much less than the width of either of the major face walls of said plank members, the first transverse wall including an opening to provide an undercut channel to receive supporting or mounting means, a connector portion projecting laterally from each side wall, the two connector portions projecting in opposite directions and each connector portion being head and neck shaped in cross-section, the undercut channels of the adjacent planks slidably receiving the opposed connector portions of a connector whereby the planks are restrained against lateral separation in the plane of the planks and transverse thereto and may be supported by supporting or mounting means being received in the channel in the first transverse wall of the connector.

* * * * *